US005365706A

United States Patent [19]

Elsenpeter et al.

[11] Patent Number: 5,365,706

[45] Date of Patent: Nov. 22, 1994

[54] DOOR WITH VENT WINDOW

[76] Inventors: Jeffrey Elsenpeter, 2498 Stoney La., Brea, Calif. 92621; Timothy Elsenpeter; Maryann Elsenpeter, both of 1314 W. Farlington, West Covina, Calif. 91790

[21] Appl. No.: 89,342

[22] Filed: Jul. 12, 1993

[51] Int. Cl.[5] ..... E06B 1/04

[52] U.S. Cl. ..... 52/204.1; 49/169; 292/95

[58] Field of Search ..... 292/DIG. 2, 95; 49/163, 49/168, 169, 171; 52/205, 204.1, 106

[56] References Cited

U.S. PATENT DOCUMENTS

| | | | |
|---|---|---|---|
| 616,992 | 1/1899 | Taylor | 292/95 |
| 712,449 | 10/1902 | Young | 49/169 |
| 1,100,564 | 6/1914 | Heryford | 49/169 |
| 1,186,565 | 6/1916 | Fogg | 49/169 |
| 1,453,680 | 5/1923 | Johnson | 292/95 |
| 1,463,381 | 7/1923 | Anthony | 292/95 |
| 1,581,776 | 4/1926 | Altschul | 49/169 |
| 1,703,944 | 3/1929 | Matchette | 49/169 |
| 2,219,344 | 10/1940 | Taylor | 49/169 |
| 2,516,185 | 7/1950 | Colarossi | 292/95 |
| 2,825,594 | 3/1958 | Hatchette | 292/95 |
| 2,847,241 | 8/1958 | Rushing | 292/95 |
| 3,226,776 | 1/1966 | Van Wormer | 49/169 |
| 3,431,000 | 3/1969 | Choiniere | 292/95 |
| 4,770,087 | 9/1988 | Danley | 49/168 X |
| 4,912,877 | 4/1990 | Strydom | 49/171 |

*Primary Examiner*—Carl D. Friedman
*Assistant Examiner*—Beth A. Aubrey
*Attorney, Agent, or Firm*—Charles H. Thomas

[57] ABSTRACT

An improved door assembly is provided in the wall of a building. A full length door is mounted in an outer door frame by a plurality of primary hinges mounted in alignment along a first vertical axis. A partial length door is mounted within an opening defined entirely within the structure of the full length door by means of secondary hinges aligned along a second, vertical axis laterally spaced from the first. The partial length door is movable inwardly in rotation about the second vertical axis between open and closed positions relative to the full length door. A rigid link at least as long as the distance of separation between the primary and secondary vertical axes is secured to an interior wall surface within the building. The link releasably engages a catch on the partial length door, preferably through a hook and eye connection. The rigid link controls movement of the partial length door when the full length door is opened and shut relative to the frame while the partial length door remains opened relative to the full length door. The control of movement of the partial length door thereby prevents damage to the wall and to the inner, partial length door as well.

12 Claims, 3 Drawing Sheets

DOOR WITH VENT WINDOW

BACKGROUND OF THE INVENTION

1. Field of the Invention

The present invention relates to a door assembly in which movement of an inner secondary door formed within the structure of a larger, primary door, is controlled when opening and closing the larger door.

2. Description of the Prior Art

There are numerous situations in which a door assembly requires a certain versatility so that a full length door can be opened and shut on some occasions, but wherein only a portion of the door can be opened and shut on other occasions. One conventional device of this type is known as a Dutch door. A Dutch door is a door mounted within a frame and divided into upper and lower portions which are rotatable independently of each other about separate hinges vertically aligned with each other along a hinged edge of a door frame. The upper and lower portions of a Dutch door can typically be latched together by any conventional latching mechanism, such as a slide bolt. When the door portions are latched together, the entire door rotates as a unit about the single hinge axis located at the hinging edge of a door frame. Alternatively, the upper and lower sections can be unlatched from each other, so that the lower portion of the door can be latched shut while the upper door portion is opened. When located in an exterior wall of a building, a Dutch door provides the building with ventilation and approaching visitors can be easily observed.

A Dutch door construction is somewhat lacking in versatility, since the upper portion of the door which can be opened relative to the lower portion extends entirely across the width of the door frame. As a consequence, when the upper door portion is opened While the lower door portion remains shut, the occupant of the building is provided with relatively little security. Any intruder need merely reach through the opening within which the upper portion of the Dutch door moves and unlatch or unlock the lower door portion, thereby gaining unrestricted access to the building.

Another type of door structure in which the door is divided into separately openable portions involves the formation of a relatively small opening within a larger, primary door in which a smaller, hinged window is located. The small window can be opened while the larger, surrounding door remains shut, thus allowing an occupant of a building to view anyone standing outside of the door. Because the window is quite small, an intruder cannot reach through the window and unlatch the larger door within which the window is formed. However, because the window is quite small, the view afforded to the occupant of the building is rather limited. Furthermore, due to its small size, the window provides an opening of very limited size through which very little fresh air and few cooling breezes may pass.

The problem of limited visibility and inadequate fresh air can be solved by merely making the window opening larger, to the extent that the window hinged to the structure of the main door itself forms a smaller, secondary door within the larger, surrounding primary door. However, in a conventional door assembly of this type the relatively large size of the secondary door can cause damage to the building if it is inadvertently left open while opening the larger, main or primary door. That is, if the larger, primary door is opened while the smaller, secondary door mounted in an opening therewithin remains open, the smaller door can swing arcuately in an articulated manner and the free edge of the smaller door can gouge an interior wall surface due to its uncontrolled swing when the primary door is opened.

Also, even when the primary door is closed, the secondary door is subject to being blown by the wind back against an adjoining wall surface due to the substantial size of the secondary door. Furthermore, because the secondary door is able to swing so widely relative to the moving plane of the primary door as the primary door itself is opened, the secondary door can often strike the interior wall surface within a building with sufficient force to shatter any glass panes that may be mounted in the secondary door. In addition, the swing of the secondary door within the room is relatively unpredictable, so that a room occupant standing close to the door can be injured by the uncontrolled swinging secondary door as the primary door is opened. Therefore, in conventional secondary doors of this type it is essential for the secondary door to be closed and latched relative to the primary door each time the primary door is opened.

SUMMARY OF THE INVENTION

According to the present invention a full length, primary entry door is provided with an interior frame within which an upper, smaller secondary door or upper central portion is hinged to swing about a secondary vertical axis located interiorally from and parallel to the primary axis of the primary door. This hinged inner, secondary, partial length door may be latched shut into the full lengthen, primary door itself to move with the primary door, or unlatched from the primary door so that it may be opened while the primary door remains closed.

Unlike a conventional Dutch door, the door assembly of the invention has secondary hinges mounted within an opening in the structure of the primary door, rather than merely a horizontal division in the door itself. Typically a screen will be mounted on the exterior surface of the primary door in the opening for the secondary door. This allows the partial length door within the frame of the full length door to be left open so as to admit fresh air through the screen in the door. Nevertheless, the door itself can remain closed and locked. When locked the door cannot be opened from the outside merely by reaching over the top of the lower section, as with a Dutch door. To the contrary, the security of the entry door is maintained while providing a large vent window for the circulation of fresh air.

A very important feature of the invention is that the secondary door mounted in the primary door can be releasably latched to an interior wall surface within a building with a rigid link that may be formed as hook several inches in length. A hook and eye connection can be used in this regard and the hook is typically about six to eight inches long. By utilizing this connection, the secondary door in the primary door can be held open and will not swing in the breeze.

Moreover, the entire primary door can be opened and shut while the secondary door mounted in the primary door remains latched to the wall and open relative to the primary door. This feature allows a user to open the primary door without having to first close and latch the secondary door. Because of the rigid link arrangement, the secondary door mounted in the primary door will move as required to permit the primary door to be opened and shut, and will not bang against either the wall or the primary door in the process.

In one broad aspect the present invention may be considered to be a double door assembly comprising an outer door mounted within an outer door frame in a building along a primary vertical hinging edge of the frame, a plurality of outer door hinges attached to the outer door and to the outer frame at the primary hinging edge and vertically aligned along a first vertical axis, an inner door opening defined entirely within and surrounded by the outer door and defining a secondary vertical hinging edge parallel to and spaced inwardly on the outer door from the primary vertical hinging edge a distance no greater than one half the width of the inner door opening, an inner door, a plurality of inner door hinges attached to the inner door and to the outer door at the secondary hinging edge and vertically aligned along a second vertical axis to mount the inner door for rotation between opened and closed positions relative to the outer door, a catch on the inner door remote from the secondary hinging edge, and a rigid link.

The rigid link is at least as long as the distance between the first and second vertical axes. The rigid link is secured at one end to an inside wall surface of the building and is releasably engageable at its opposite end with the catch on the inner door when the inner door is in its opened position. In this way the rigid link constrains movement of the inner door which remains in its opened position when the outer door is opened relative to the outer door frame.

When the outer or primary door is opened relative to the door frame with the inner or secondary door latched to the interior wall surface by means of the rigid link, the edge of the inner, secondary door remote from the secondary vertical hinging edge cannot swing freely relative to the inner door hinges. To the contrary, the free edge of the inner door can swing, but is controlled in its movement by the rigid link to move in an arcuate path and at a safe distance from the wall. This constraint in movement of the inner, secondary door is particularly important when an interior wall surface exists proximate to the primary hinge edge of the door frame, and in a plane substantially perpendicular to the orientation of the door frame. The constraint provided by the rigid link in such a situation is particularly important, since without it the edge opposite the hinged edge of the inner, secondary door could otherwise strike the adjacent wall surface even if the larger, primary door is only partially opened a short distance.

Preferably the rigid link and the catch form a hook and eye connection, whereby a hook, located on either the link or the catch, can be releasably engaged on an eyelet located on the other of those members. Typically the hook will be formed on the free end of the rigid link, while the catch will be formed with an eyelet that is secured to the inner door at a location thereon remote from the secondary hinge axis.

The improved door structure of the present invention provides the occupants of a building with a rather large secondary partial door formed entirely within a full length primary door in an entryway into a building. A full length door of this type normally extends from the threshold to a height of about eighty inches and a width typically between about thirty and thirty six inches. The relatively large portal or partial door is typically no smaller than about two foot square and allows a considerable amount of fresh air to enter the building, without requiring the full length, primary door to be opened. By engaging the catch with the rigid link, the free edge of the inner secondary door is held away from the interior building wall surfaces, so that sharp gusts of wind cannot slam the edge opposite the hinged edge of the inner door against the interior wall surfaces.

Because the size of the inner door is relatively large, a screen is preferably mounted across the inner door opening on the exterior surface of the outer door. This ensures a considerable measure of security, so that one approaching the building cannot simply reach through the inner door opening and unlatch the larger, full length door from outside the building. Also, a screen across the inner door opening ensures that unwanted debris, such as leaves and paper, cannot be blown into the building through the inner door opening. The screen also provides a barrier to insects.

A door assembly structure formed according to the invention provides considerable flexibility in the size of the secondary door and the corresponding opening in the larger, full length primary door. The inner, secondary door normally has a width at least as great as the distance between the two vertical axes about which the inner and outer doors rotate, but more often is considerably larger. Indeed, the width of the inner door can approach that of the outer door, although the structure of the outer door must surround the inner door entirely so as to serve as a frame for the inner door. Within these constraints, however, the inner door can be virtually any size.

In another broad aspect the invention may be considered to be an improvement in a door assembly mounted in a building and having an outer frame and a full length door mounted in the outer frame by means of a plurality of hinges mounted in alignment along a first vertical axis at a primary hinging edge of the outer frame. The improvement is comprised of a partial length door mounted within an opening defined entirely within the structure of the full length door and having a secondary hinging edge parallel and proximate to and spaced from the primary hinging edge. The full length door forms an inner frame that entirely surrounds the partial length door. A plurality of secondary hinges mount the partial length door within the opening and are vertically aligned along a second vertical axis at the secondary hinging edge of the opening.

With this construction the partial length door is moveable inwardly in rotation about the second vertical axis between open and closed positions relative to the full length door. A rigid link at least as long as the distance of separation between the primary and secondary hinging edges is secured at one end to an interior wall surface within the building and has a fastening means at its opposite end. A catch is provided on the partial length door remote from the secondary hinging edge. The catch is releasably engageable by the fastening means of the rigid link. The rigid link thereby controls movement of the partial length door when the full length door is moved relative to the outer door frame with the partial length door opened relative to the full length door.

The invention may be described with greater clarity and particularity with reference to the accompanying drawings.

DESCRIPTION OF THE EMBODIMENT

Figure 1:
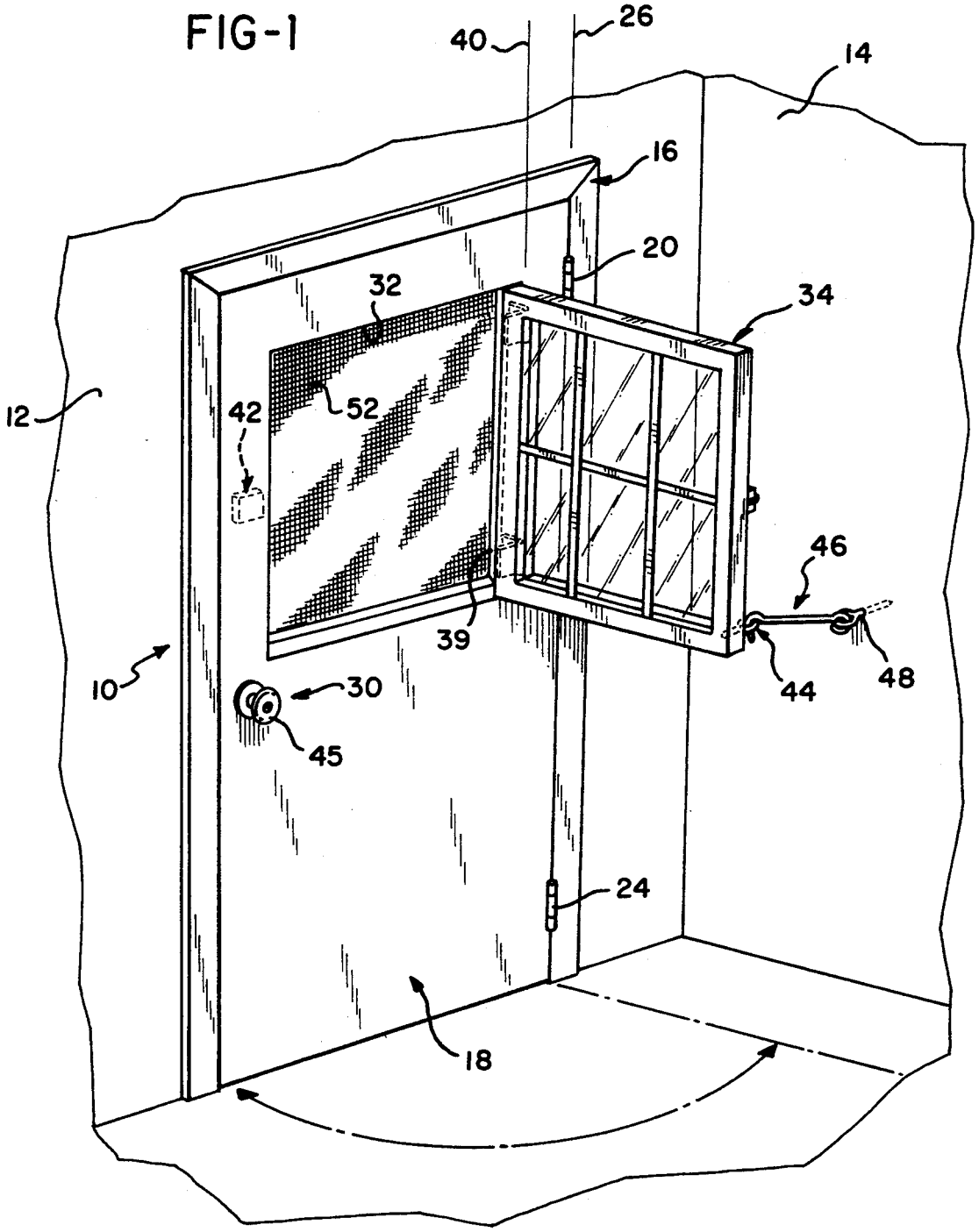
FIG. 1 is a perspective view showing a preferred embodiment of the door assembly of the invention from the inside of a building in which the door assembly is mounted.

FIG. 1 illustrates a door assembly indicated generally at 10 mounted in a building having upright walls that include interior wall surfaces 12 and 14. The door assembly 10 is comprised of an outer entryway door frame 16 disposed in an opening in the exterior wall 12 of the building. A primary, rectangular full length outer door 18 is disposed within the outer door frame 16. The primary door 18 is mounted within the frame 16 by means of three primary hinges 20, 22 and 24 that are attached to a primary hinging edge 25 of the outer frame 16. The primary hinges 20, 22 and 24 are linearly aligned in vertically spaced separation from each other along a first vertical axis 26. The primary door 18 is thereby rotatable relative to the frame 16 upon the primary hinges 20, 22 and 24 about the first vertical axis 26. The primary door 18 has a conventional lock set 30 with an exterior doorknob 43 and an interior doorknob 45 to latch and lock the door 18 relative to the frame 16.

An upper, central interior opening 32 is defined entirely within the peripheral confines of the primary full length door 18. A secondary door 34 is mounted by means of vertically spaced secondary hinges 36 and 38 attached to a secondary vertical hinging edge 39 bounding the opening 32 along a second vertical axis 40 that is laterally spaced inwardly on the primary door 18 from the first vertical axis 26. The distance of axis separation between the axes 26 and 40 is no greater than one half the width of the secondary door 34, and is typically considerably less. The secondary door 34 is moveable inwardly into the room partially bounded by the walls 12 and 14 between open and shut positions relative to the primary door 18, as shown in FIGS. 3 and 4.

Figure 2:
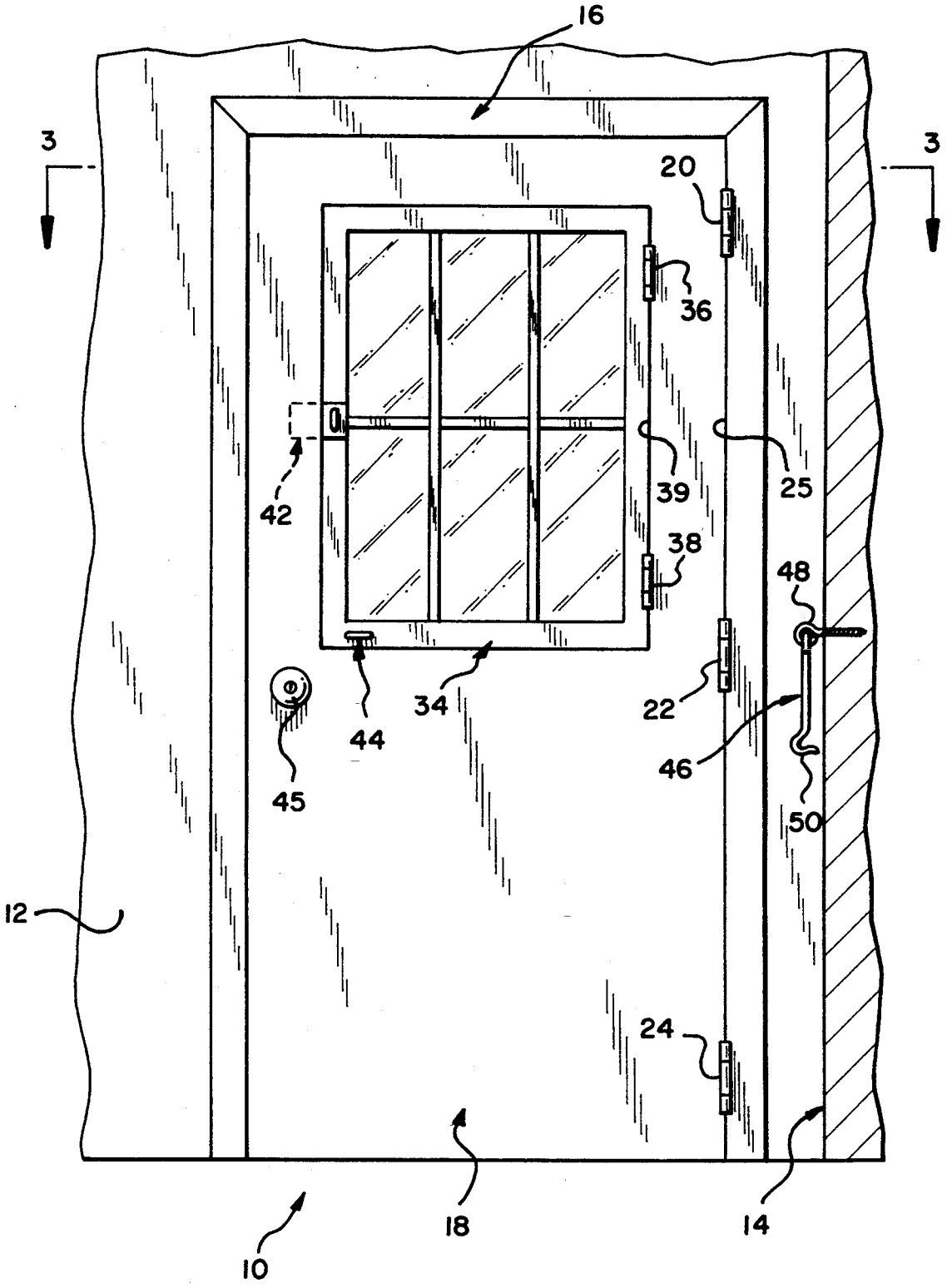
FIG. 2 is an elevational view of the door of FIG. 1.

The door assembly 10 includes a conventional latch mechanism 42 mortised into the primary and secondary doors 18 and 34 for releasably latching the secondary door 34 shut relative to the primary door 18 as illustrated in FIG. 2. A catch 44 in the form of an eyelet having a threaded shank is fastened to the secondary door 34 remote from the second vertical axis 40. That is, the catch 44 is located on the secondary door 18 near the edge thereof at which the latch mechanism 42 is located and remote from the secondary hinging edge 39 of the opening 32.

Figure 3:
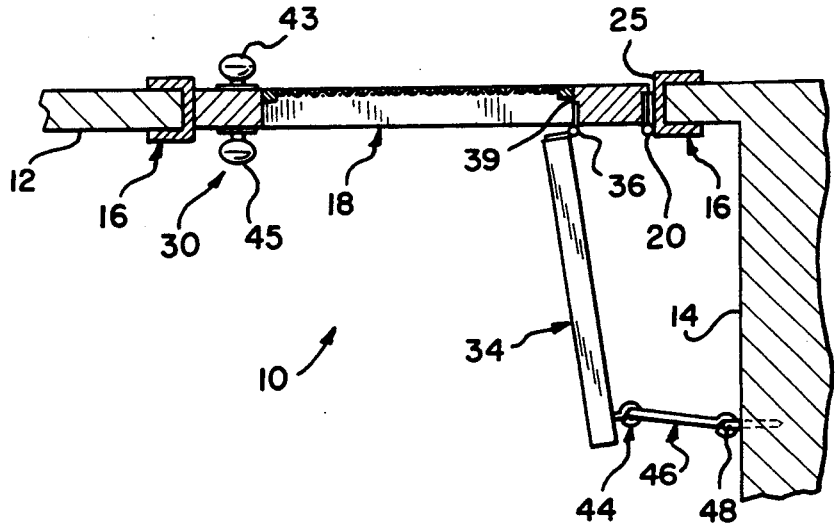
FIG. 3 is a sectional plan view taken along the lines 3—3 of FIG. 2 showing the inner, secondary door of the invention releasably engaged by the link in an opened position while the outer, full length door remains in a closed position.
Figure 4:
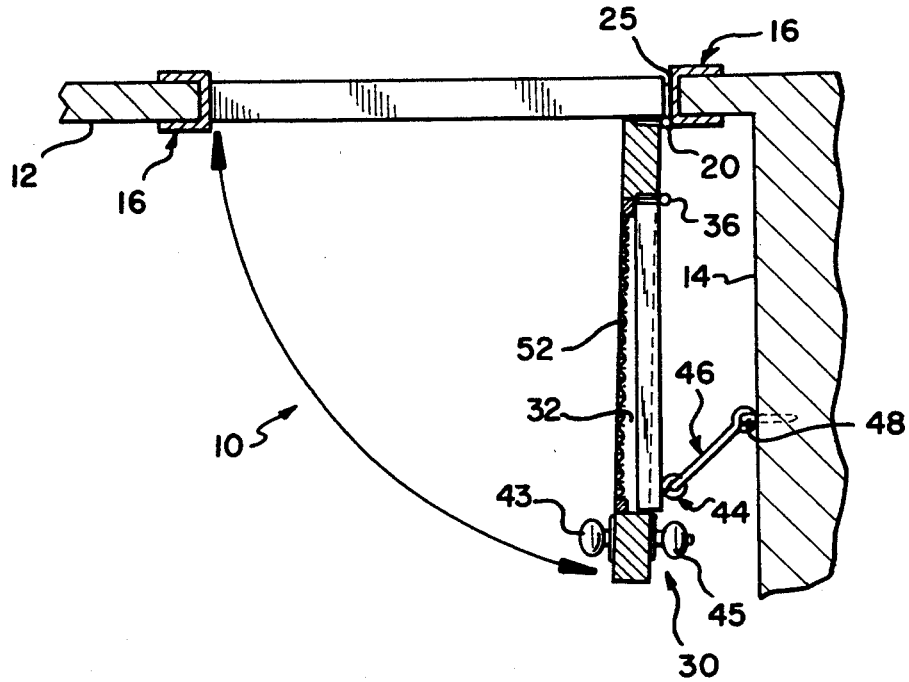
FIG. 4 is a sectional plan view taken along the lines 3—3 of FIG. 2 illustrating the constraint of movement of the inner, secondary door when the outer, primary door opened from the position of FIG. 3.

As shown in FIGS. 1,3 and 4, the door assembly 10 includes a screen 52 that is mounted across the inner door opening 32 on the exterior surface of the outer, primary door 18. The screen 52 provides a measure of security prevent anyone outside the building from reaching through the opening 32 to reach the lock set 30 so as to open the primary door 18. The screen 52 also prevents leaves and other debris from being blown into the room, and provides a barrier to insects as well.

The door assembly 10 includes a rigid link 46 that is provided in the form of a metal rod having a shank approximately six to eight inches long. The link 46 is mounted on the interior wall surface 14 by means of a conventional threaded anchor 48. The wall surface 14 is oriented perpendicular to the orientation of the door frame 16 and perpendicular to the wall surface 12. The wall surface 14 meets the wall surface 12 near the primary hinging edge 25 of the door frame 16. The anchor 48 loosely grips a loop in one end of the link 46 and secures the link 46 relative to the door frame 16 at a location in the wall 14 proximate thereto. The link 46 has a length at least as great as the distance of separation of the axes 26 and 40.

The end of the link 46 remote from the anchor 48 terminates in a hook 50 that is engageable in the eye catch 44. The rigid link 46 is thereby releasably engageable with the catch 44 when the secondary door 34 is opened relative to the primary door 18, as shown in FIG. 1. This allows the primary door 18 to open and close relative to the door frame 16 while the rigid link 46 remains engaged with the catch 40, as illustrated in FIGS. 3 and 4.

As shown in FIGS. 3 and 4, the inwardly facing wall surface 14 resides in a plane perpendicular to the orientation of the outer frame 16. When the door assembly 10 is located in a corner in this manner, the inner door 34 would be quite likely to strike and damage the wall surface 14 when the outer door 18 is opened from the position of FIG. 3 to the position of FIG. 4 unless the rigid link 46 is provided and engaged. However, by employing the rigid link 46, the movement of the unhinged, free edge of the inner door 34 remote from the secondary hinging edge 39 of the opening 32 is controlled and constrained, so that it will not strike the wall surface 14. To the contrary, when the outer, full length door 18 is closed as illustrated in FIG. 3, the free edge of the inner door 34 is held at a distance from the wall surface 14 determined by the length of the link 46. When the outer door 18 is opened, the free edge of the inner door 34 travels in a controlled, arcuate path, but remains held at a distance from the wall surface 14 at all times. Preferably the link 46 is long enough so that the inner door 34 is closed completely into the plane of the outer door 18 while the inner door knob 45 of the lock set 30 still remains in spaced separation from the wall surface 14. This prevents the door knob 45 of the lock set 30 from striking the wall surface 14.

As is evident from the drawings, the use of the rigid link 46 provides the door assembly 10 with a substantial measure of control over movement of the inner door 34 when the outer door 18 is opened. This control of the movement of the inner door 34 prevents damage not only to the wall 14, but to the inner door 34, particularly when the outer, full length door 18 is opened rapidly.

Figure 5:
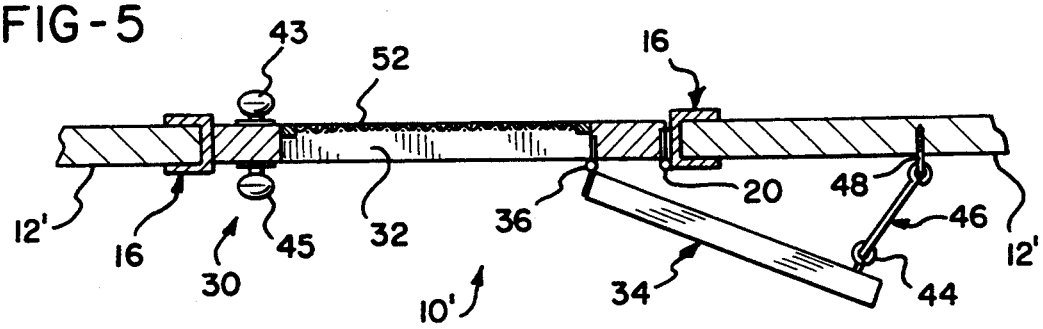
FIG. 5 is a sectional plan view of another embodiment of the invention similar to FIG. 3 but in which the outer door is not located proximate to a wall perpendicular thereto.

FIG. 5 illustrates another embodiment 10' of the invention in which a secondary door 34 is mounted within a primary door 18. The embodiment of FIG. 5 differs from that of FIGS. 3 and 4 in that the primary door 18 is located within a long wall 12' and not near any wall perpendicular thereto. The link 46 is secured to the wall 12 rather than to a different wall perpendicular thereto. Nevertheless, the hook 50 of the link 46 is engageable with the catch 44 so as to control the movement of the secondary door 34 as the primary door 18 is moved completely through a wide obtuse arc between the closed position shown in FIG. 5 and a fully opened position back against the wall 12'.

Undoubtedly, numerous variations and modifications of the invention will become readily apparent to those familiar with building door assemblies. For example, the hook and eye arrangement in the embodiment illustrated could be reversed, with the link 46 carrying an eyelet on its free end while the catch 44 could be formed as an upstanding finger or hook. Also, the link 46 could be mounted on the secondary door 34 and the catch 44 could be mounted on the adjacent wall. Moreover, a duplicate link system can De used to separately latch each of the doors in an entryway assembly in which a pair of doors are mounted side by side. Numerous other modifications and variations of the invention may be employed as well without departing from the scope of the invention. Accordingly, the scope of the invention should not be construed as limited to the specific embodiments illustrated and described.

We claim:

1. A double door assembly for a building having walls with an entryway through one of said walls and an inside wall surface within said building thereby defining as an inwardly direction a direction through said entryway proceeding therethrough toward said inside wall surface, and an outer frame located in said entryway, said outer frame having a primary vertical hinging edge located proximate said inside wall surface, comprising; an outer door mounted within said outer frame along said primary vertical hinging edge of said outer frame, a plurality of outer door hinges attached to said outer door and to said outer frame at said primary hinging edge thereof and vertically aligned to define a first vertical axis, an inner door opening defined entirely within and surrounded by said outer door and defining a secondary vertical hinging edge parallel to and spaced laterally on said outer door from said primary vertical hinging edge a distance no greater than one half the width of said inner door opening, an inner door having one vertical hinged edge and an opposite vertical free edge remote from said secondary vertical hinging edge, a plurality of inner door hinges attached to said inner door at said one hinged edge thereof and to said outer door at said secondary hinging edge and vertically aligned to define a second vertical axis about which said inner door is mounted for rotation between open and closed positions relative to said outer door, a catch on said inner door remote form said secondary hinging edge, an omnidirectional coupling mounted on said inside wall surface of said building and a rigid link at least as long as the distance between said first and second vertical axes and having a first end and an opposite second end, wherein said link is secured at said first end to said inside wall surface of said building by means of said omnidirectional coupling and releasably engageable at said second end with said catch wherein said catch captures said second end of said link therewith when said inner door is in said open position, whereby said rigid link constrains movement of said inner door in its open position when said outer door is opened relative to said outer frame to hold said free edge of said inner door at a distance from said inner wall and confine movement of said free edge to a controlled arcuate path to prevent said inner door from contacting said inside wall surface.

2. A double door assembly according to claim 1 further comprising a screen mounted across said inner door opening on an exterior surface of said outer door.

3. A double door assembly according to claim 1 wherein said catch forms an eyelet and said opposite end of said rigid link forms a hook releasably engageable in said eyelet.

4. A double door assembly according to claim 1 wherein said inside wall surface resides in a plane perpendicular to the orientation of said outer frame.

5. In a door frame assembly mounted in a building having walls and an inside wall surface, an entryway formed through one of said walls thereby defining an inwardly direction as that direction proceeding through said and toward said inside wall surface, an outer frame located in said entryway and defining a primary hinging edge proximate said inside wall surface, a full length door mounted in said outer frame, a plurality of primary hinges mounted in vertical alignment with each other to define a first vertical axis at said primary hinging edge of said outer frame, the improvement comprising an opening defined entirely within the structure of said full length door and defining a secondary hinging edge parallel and proximate to and spaced from said primary hinging edge, a partial length door mounted within said opening at said secondary hinging edge whereby said full length door forms and inner frame that entirely surrounds said partial length door and wherein said inner door has a free inner door edge, a plurality of secondary hinges mounting said partial length door to said full length door within said opening therein, said secondary hinges being vertically aligned with each other to define a second vertical axis at said secondary hinging edge of said opening, whereby said partial length door is moveable inwardly in rotation about said second vertical axis between open and closed positions relative to said full length door, an omnidirectional coupling mounted on said inside wall surface, a rigid link at least as long as the distance of separation between said primary and secondary hinging edges and having one end secured by said omnidirectional coupling to said interior wall surface within said building and having an opposite end with a fastening means therein, and a catch on said partial length door located remote from said secondary hinging edge and releasably engageable by said fastening means of said rigid link to thereupon hold said free edge of said inner door at a distance from said inside wall surface an control movement of said partial length door to limit travel of said free inner door edge to an arcuate path to prevent contact of said partial length door with said inside wall surface when said full length door is moved relative to said outer door frame with said partial length door opened relative to said full length door.

6. A door assembly according to claim 5 wherein said catch and said opposite end of said rigid link form a hook and eye connection.

7. A door assembly according to claim 5 wherein said interior wall surface to which said one end of said link is secured is oriented perpendicular to the orientation of said outer frame.

8. A door assembly according to claim 5 further comprising a screen secured across said opening on the exterior surface of said full length door.

9. A door assembly mounted in a building having upright walls with inside surfaces and an entryway in one of said upright walls that defines movement inwardly as a direction proceeding through said entryway into said building comprising: an outer door frame disposed in said entryway, a primary door disposed within aid outer door frame, a plurality of primary hinges mounting said primary door to said outer door frame, said hinges being linearly aligned along a first vertical axis, whereby said primary door is rotatable relative to said outer door frame upon said primary hinges, an upper, central opening defining entirely within the periphery of said primary door, a secondary door mounted in said opening and defining a hinged edge and an opposite free edge, vertically spaced secondary hinges mounting said secondary door at its hinged edge in said opening, said secondary hinges defining a second vertical axis spaced from said first vertical axis a distance of axis separation no greater than one half the width of said secondary door whereby said secondary door is moveable inwardly between open and closed positions relative to said primary door, a latch for releasably latching said secondary door closed relative to said primary door, a catch fastened to said secondary door remote from said second vertical axis, an omnidirectional coupling mounted on one of said inside wall surfaces, a rigid link mounted on said one of said wall surfaces of said building proximate said door frame by means of said omnidiectional coupling and having a length at least as great as said distance of axis separation, whereby said rigid link is releasably engageable with said catch when said secondary door is opened relative to said primary door so as to allow said primary door to open and close relative to said outer door frame while holding said free edge of said secondary door at a distance from said inside wall surfaces and limiting travel of said free edge of said secondary door to an arcuate path and thereby preventing said secondary door from contacting said inside wall surfaces while said rigid link remains engaged with said catch.

10. A door assembly according to claim 9 wherein said rigid link and said catch form a releasably hook and eye connection.

11. A door assembly according to claim 9 wherein said interior wall surface is oriented perpendicular to the orientation of said door frame.

12. A door assembly according to claim 9 further comprising an outer screen mounted across said opening.

* * * * *